United States Patent [19]

Astle, Jr.

[11] Patent Number: 5,005,556

[45] Date of Patent: Apr. 9, 1991

[54] EFFICIENT GAS HOT-AIR FURNACE AND HEATING PROCESS

[76] Inventor: William B. Astle, Jr., 146 Old Farm Rd., Leominster, Mass. 01453

[21] Appl. No.: 364,614

[22] Filed: Jun. 8, 1989

[51] Int. Cl.[5] ..... F24H 3/06; F28D 19/04

[52] U.S. Cl. ..... 126/110 R; 126/110 B; 126/110 D; 126/110 C; 165/7; 165/10

[58] Field of Search ..... 165/7, 10; 126/110 R, 126/110 B, 110 D, 110 C

[56] References Cited

U.S. PATENT DOCUMENTS

| | | | |
|---|---|---|---|
| 3,338,300 | 8/1967 | Turunen et al. . | |
| 3,695,250 | 10/1972 | Rohrs et al. | 165/7 |
| 3,823,766 | 7/1974 | Sawyer | 165/10 |
| 4,754,806 | 7/1988 | Astle Jr. | 165/10 |
| 4,836,183 | 6/1989 | Okuno et al. | 165/7 |
| 4,909,190 | 3/1990 | Finch | 165/7 |

FOREIGN PATENT DOCUMENTS

| | | | |
|---|---|---|---|
| 220867 | 8/1924 | United Kingdom | 165/6 |
| 760803 | 11/1956 | United Kingdom | 165/6 |

OTHER PUBLICATIONS

*Energy Conservation Through Heat Recovery*, Northern Natural Gas Company.

*Z Duct Energy Recovery Unit*, Des Champs Laboratories, Inc. Bulletin 3-75C, 3 Drawings, and 2 Sheets of Performance Data.

*Primary Examiner*—Albert W. Davis, Jr.

*Attorney, Agent, or Firm*—Fish and Richardson

[57] ABSTRACT

Substantially all available heat from a combustion gas stream is extracted by passing it through a cool, porous heat sink, which is thereby heated, and then releasing that heat into a cool air stream blown through the same porous heat sink in a second step (preferably in the opposite flow direction). The heat sink absorbs substantially all the available heat of combustion rather than merely scavenging what would otherwise be stack losses. The invention provides an improved means of recovering virtually all the available heat produced by combustion of a fuel gas. It permits recovery of the heat lost in a conventional single-zone furnace. The improved heat recovery is achieved without contamination of the ambient air with exhaust gas residues as occurs in direct-fired systems, and without incurring the problems of corrosion and waste disposal inherent in two-zone indirectly-fired systems. The invention differs from traditional stack-gas heat-salvaging processes in that there is only one heat transfer zone for transferring combustion heat to an ambient air stream.

31 Claims, 6 Drawing Sheets

HOT GAS DIRECTION

°F
1000
900
800
700
600
500
400
300
200
100
0
GAS
HEAT-SINK
501
502
COOL AIR DIRECTION

HEAT-SINK
AIR

EFFICIENT GAS HOT-AIR FURNACE AND HEATING PROCESS

BACKGROUND OF THE INVENTION

This invention relates to furnaces, particularly those using natural gas or other clean burning fuel gases.

Comfort and utility heating processes are widely dependent on burning combustible gases with air in a variety of furnaces. Among the prominent fuel gases are those that are essentially wholely hydrocarbon such as methane or propane. Others are mixtures of carbon monoxide and hydrogen, as such, or blended with hydrocarbon gases. Frequently these gases carry along noncombustible species such as nitrogen and water. Whatever the fuel used it is well known that conventional furnaces are rarely operated in such a way as to utilize all the potentially useful enthalpy available from the actual combustion. This is, in broadest terms, due to the fact that the gaseous combustion products are normally conducted away from the fire zone through heat exchange arrangements which extract only a part of the thermal energy so that the combustion gas residues remain at sufficiently high temperature to facilitate effective convective ejection of the exhaust gas through stacks and the like.

However, even when forced draft is used to remove and dispose of the exhaust gases, they have, until fairly recently, still rarely been deliberately cooled below the so-called dew-point (that temperature at which the concentration of water vapor is high enough to reach or exceed saturation.)

All fuel gas combustion with air results in the formation of water vapor and carbon dioxide as principal products. Depending on air-to-combustible gas feed ratio, there will be some small amount of carbon monoxide; depending on combustion temperature there will be oxides of nitrogen (designated NOx) also formed. The resulting gas must inevitably contain a large fraction of nitrogen since all normal air fed to the combustion zone will carry about 4 volumes of nitrogen for each volume of oxygen. But the air supplied to the fire is more than oxygen and nitrogen. There is always some amount of water vapor as well as small amounts of other gases (argon, $CO_2$, transient hydrocarbons, and occasionally sulfur or halogen-bearing volatiles). The moisture in the air supply adds slightly to the moisture of the combustion gas. It is also noteworthy that the ratio of water to carbon dioxide in the combustion gas is quite dependent on the combustible gas being burned. Propane, with a higher carbon/hydrogen ratio (3:8) than methane (1:4), yields less water vapor; on the other hand, some natural gas supplies and manufactured gases inherently carry their own burden of water.

Dew-point is not the same for all fuel gas combustion processes. Besides the factors cited above it is influenced by the oxygen concentration used in converting the fuel to carbon dioxide and water. In some industrial processes, for example, feed air is occasionally enriched with raw oxygen to create a higher flame temperature. The combustion gas contains less nitrogen, and therefore a higher partial pressure of water. On the other hand one can feed excess air, resulting in a higher burden of nitrogen and therefore a lower partial pressure of water vapor in the exhaust gas. For practical purposes, however, in uses to which the present invention applies it is reasonable to expect a dew-point within a few degrees around 65° C. (150° F.).

Traditional furnaces embody the indirect-fired heating process; that is, the flame heat is transferred across a barrier into the heated fluid medium (air or water, as the case may be). Most of the time these systems transfer as little as 60% of the combustion heat into the heated fluid, the balance being retained in the combustion exhaust gas in order to assure its efficient disposal by thermal convection.

This waste of fuel heat value has prompted several developments. One, the so called direct-fired process, blends air to be heated with combustion gases directly without an intervening barrier. While it eliminates stack heat losses completely, the process is unsuitable for heating a stream of recirculating ambient air because of the potential of noxious gas buildup. The source of air for direct-fired heating is almost always the outdoors, which is invariably colder than the space to be heated. Thus, while the process is efficient in the sense of using all the thermal energy of the fuel, it is inefficient from the point of view of conserving heat in the space to be heated. It is most suitable for providing make up air in a space which has some other primary source of comfort heating but which suffers air losses from time to time such as in a warehouse with frequent opening and closing of doors and a fair amount of air loss to the outside. When the direct-fired process is used as the primary heating method, it is expected that continuous leakage of air to the outdoors will be in balance with the flame-heated air being brought in. By this arrangement the fraction of non-air gases is kept tolerably low.

Indirect-fired units operating under normal conditions emit approximately 50 to 200 ppm of CO (carbon monoxide), a maximum of 110 ppm of $NO_x$, and 8000 to 10000 ppm of $CO_2$, which is all vented to atmosphere. Direct-fired units operating under normal conditions will emit approximately 3 to 5 ppm of CO, 3 to 8 ppm of $NO_x$, and a maximum of 2000 ppm of $CO_2$, which is diluted by outside air as it enters the building.

Another approach to recovering more useable heat from the exhaust gas in indirect-fired combustion processes is the "high efficiency" furnace. These furnaces use two heat exchange zones: a primary zone, in which the combustion occurs, and a secondary zone, where the exhaust gases exit and cool ambient air is introduced. Exhaust gases leaving the primary zone are not removed by thermal convection as in the conventional furnace. Instead, the exhaust gases are drawn through the secondary zone by a suction fan, where they are cooled by counterflowing, incoming cool ambient air. This preheats the incoming ambient air before it enters the primary heat-exchange zone.

There are several consequences of this two-stage process. First, of course, there is a desirable effect of recovering substantially all of the sensible heat in the exhaust gas that would, in the conventional furnace, escape up a stack. But there is also the unavoidable consequent effect of creating an exhaust gas density so high that convective ejection is no longer feasible. Thus, the exhaust gas must be withdrawn and discharged from the secondary zone by means of a positive air conveyance device such as a blower or fan. Because of the cooling, however, the exhaust is also reduced in volume. These two effects (cooler and lower volume) make it possible to discharge the exhaust through smaller size ducts made of materials such as polymers which would not be suitable for the conventional furnace stacks. But another important consequence of the two-stage operation, one which is recognized as a major drawback, is that cooling of the exhaust gas to near ambient temperature in the secondary heat exchanger results inevitably in dropping the temperature of the gas below its dew-point. This causes water vapor to condense as droplets or films on the exhaust-side surfaces of the secondary zone heat exchanger. This has the desirable effect of recovering the latent heat of evaporation, but the resulting water condensate is a problem. As has already been noted, the exhaust gas contains not only nitrogen, carbon dioxide, and water vapor, but also traces of carbon monoxide and nitrogen oxides, and not infrequently also small amounts of sulfur oxides and even hydrochloric acid vapor (generated by decomposition of chlorine-bearing volatiles carried into the flame zone as contaminants of the fuel gas or combustion air). All gases are capable of dissolving to one extent or another in water. Thus, the condensed water vapor tends to absorb components from the exhaust gas to which it is exposed. Some of these components produce acidic aqueous solutions. Although the gases would dissolve only sparingly in boiling water, they dissolve more readily in the near ambient temperature which the exhaust gas is brought down to in the secondary zone. The result is creation of a highly corrosive liquid, which is the source of two serious problems. First, materials, even most grades of stainless steel, that might be used in the secondary heat exchange zone are in serious jeopardy of early failure. Second, the acidic liquid is environmentally offensive material that may be unacceptable to discharge in the sewage systems.

Another approach to recovering heat from exhaust gas is to scavenge the heat from the stack. But each of these schemes, despite variations in their design, has no effect on the primary heat transfer stage taking place in the conventional furnace fire-box. The devices are designed for and operate only to reduce the combustion heat losses occasioned by the convective ejection through stacks or exhaust gases at temperatures several hundred degrees above ambient. For example, Astle U.S Pat. No. 4,754,806, issued to the present inventor, shows a device that is very effective at removing stack heat, but it, too, is intended to work downstream of the primary heat exchanger of the conventional furnace.

SUMMARY OF THE INVENTION

The invention provides an improved means of recovering virtually all the available heat produced by combustion of a fuel gas. It permits recovery of the heat lost in a conventional single-zone furnace. The improved heat recovery is achieved without contamination of the ambient air with exhaust gas residues as occurs in direct-fired systems, and without incurring the problems of corrosion and waste disposal inherent in two-zone indirectly-fired systems. The invention differs from traditional stack-gas heat-salvaging processes in that there is only one heat transfer zone for transferring combustion heat to an ambient air stream.

In general, the invention features extracting substantially all available heat from a combustion gas stream by passing it though a cool, porous heat sink, which is thereby heated, and then releasing that heat into a cool air stream blown through the same porous heat sink in a second step (preferably in the opposite flow direction). The heat sink absorbs substantially all the available heat of combustion rather than merely scavenging what would otherwise be stack losses.

In preferred embodiments, the temperature of the combustion gases exiting the porous heat sink member is reduced to within 30° F. (more preferably 20° F.) of the temperature of the ambient air entering the heat sink member; ambient air is directed to the heat sink member along two separate ambient air paths; portions of the heat sink member pass alternately through both the combustion gas path and ambient air path; combustion gases are cooled to below dew point in passing through the heat sink member; ambient air is partially humidified on passing through the heat sink member as the result of re-evaporation of any water vapor condensate formed within the heat sink member during passage of the combustion gases; ambient purge air is passed through the porous heat sink member along a purge air path positioned immediately adjacent the combustion gas path, so that ambient purge air is drawn through each portion of the porous heat sink member immediately following passage of that portion through the combustion gas path, thereby purging each portion of any toxic gases left by passage of the combustion gases; the temperature of the combustion gases is adjusted by adjusting the ratio of fuel gas to air delivered to the combustion process; the combustion chamber is defined by a canopy and the temperature of the combustion gases is adjusted by partial cooling of the canopy; a metal mesh is used for the porous heat sink member.

A preferred arrangement of porous heat sink member and hot and cold air paths is described in detail in U.S. Pat. No. 4,754,806, which is incorporated by reference.

The invention has several advantages. For example, combustion gases are ultimately cooled nearly to ambient temperature, while combustion gas and ambient air streams are kept substantially segregated. Thus, the invention exhibits the heat efficiency of direct-fired systems without the disadvantage of carrying combustion gases into the environment. It also incorporates into a single state the effect of the two stages of the so-called "high efficiency" units, and this improved performance is achieved without creating offensive dew-point liquid. Yet the exhaust gas stream of the invention may be cooled below the combustion gas dew-point, and moisture vapor which condenses in the heat sink is rapidly re-evaporated into the air stream (before harmful corrosion can occur to the porous heat sink member), contributing thereby to comfort humidification.

Other features and advantages of the invention will be apparent from the following description of a preferred embodiment and from the claims.

DESCRIPTION OF THE PREFERRED EMBODIMENT

Figure 1:
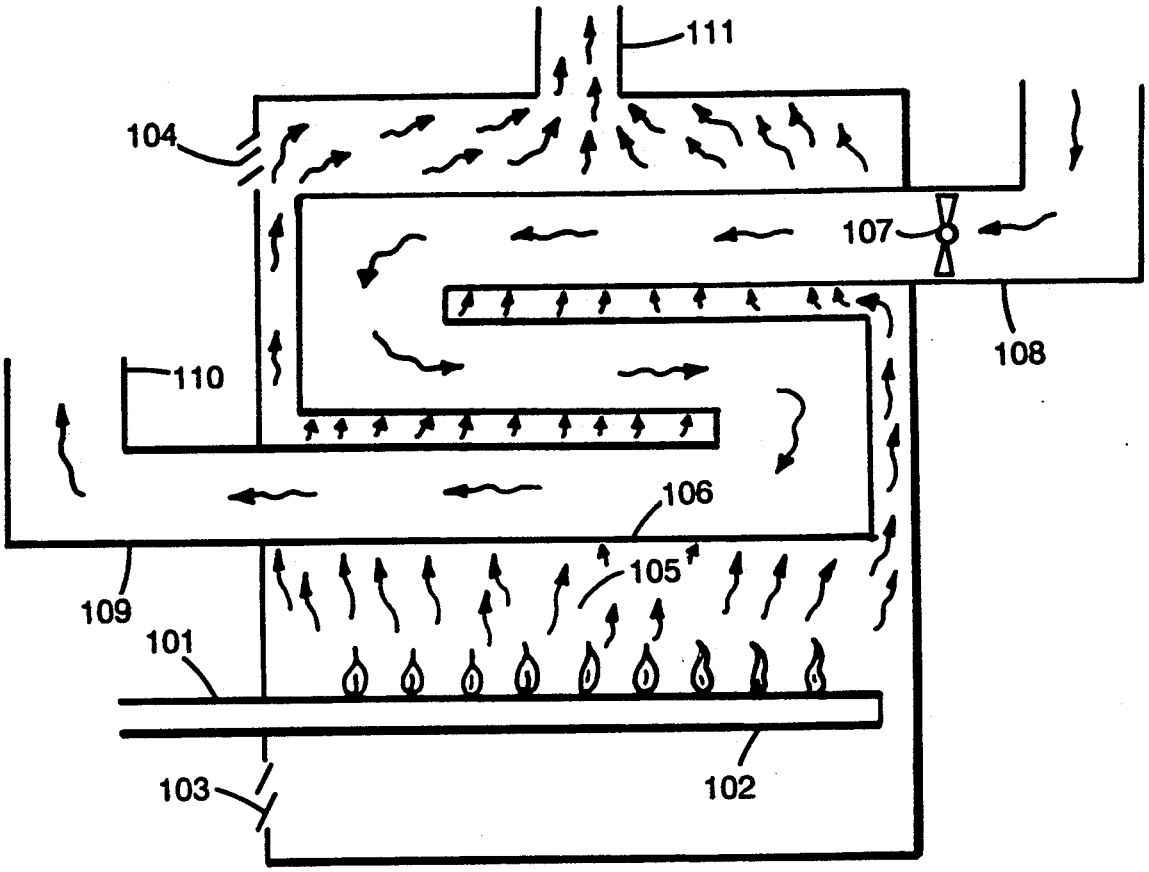
PRIOR ART FIG.1
FIG. 1 is a diagrammatic view of the principal featues of an indirectly-fired single zone furnace (prior art).

FIG. 1 is a diagrammatic, cross-sectional view through the mid-section of an ordinary single-zone hot air furnace (prior art). Fuel gas is admitted via pipe 101 to burner element 102. Combustion air is admitted at inlet 103, and (variably) supplementary air is admitted at inlet 104. Combustion occurs in fire-box 105. Various heat-exchange devices and configurations are known, but for simplicity in this figure flame-to-air heat transfer is visualized as occurring across the wall of a tubular heat-exchanger 106. Cool ambient air is blown into the tube by fan 107 which draws its air supply from a duct system connecting to an ambient air source 108. Heated air emerges at outlet 109 and is discharged into a duct system 110 for distribution. Combustion gas created by the fire, after passing over heat exchanger 106, rises by thermal convection up exhaust stack 111 and discharges to the atmosphere.

The fire-box temperature is around 1000°-1300° F. depending on fuel used and fuel-to-air ratio. Higher flame temperature results in more $NO_x$ formation. Some overfeed of air may be desired to favor conversion of CO to $CO_2$, but this will tend to keep the fire-box temperature on the lower side of the range. Exhaust gas leaves the furnace at a temperature of around 400° to 500° F., determined in part by the heat of the flame, the amount of excess air, if any, and the amount of heat transferred to the ambient air in the heat exchanger. Ambient air enters the heat exchanger conventionally somewhere between 50° and 70° and leaves around 90° to 100° F. For a typical system, exhaust flow volume may be around 50 cfm and ambient airflow about ten times that. Allowing for the fact that the hot exhaust gas is about two-thirds the density of the air, it can be estimated that the heat taken up in the cool air—500 volumes X (100°-60°)=20,000—is only about twice the heat lost up the stack—50 volumes $(\frac{2}{3})\times(400°-100°)=10{,}000$. That is, half again as much sensible heat could be captured by cooling the stack gas to 100° and transferring this heat into the air at 100°.

Figure 2:
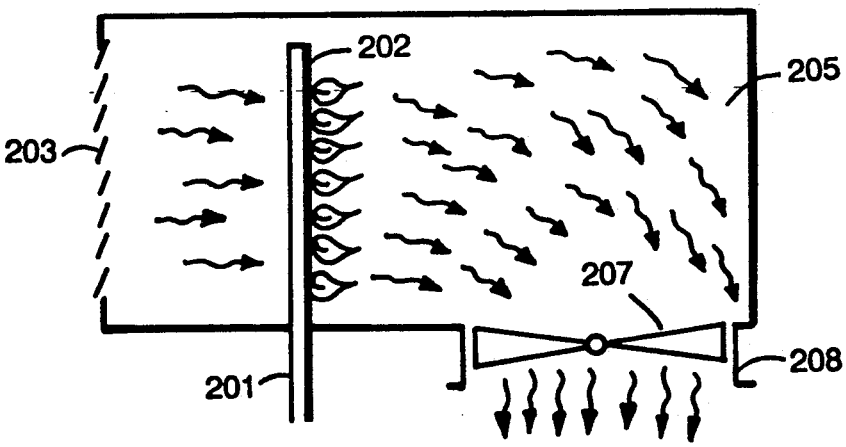
PRIOR ART FIG.2
FIG. 2 is a diagrammatic view of the principal features of a directly-fired system (prior art).

FIG. 2 depicts diagrammatically the fundamental operations of a typical direct-fired hot air system (prior art). Fuel gas enters at 201 and combustion occurs at burner 202. Admitted at 203 is air both to be heated and to sustain the fire. Fan 207 serves the combined purpose of drawing air into the fire zone 205 and, after it has been heated by the fire, discharging it to the space to be heated, via duct 208. The combined volume of heated air plus combustion products is at least ten times the gas volume, as the result of combustion. All the heat of combustion is, of course, retained in this mixture along with all the products of combustion. As has been stated earlier, this system is employed only when fresh air is being more or less continuously introduced into the heated space. For example, a warehouse may have fairly regular inflow of cold outdoor air because of frequent opening of doors. To make up for heat lost because of this, a positive input of make-up air heated to some desired temperature may be provided by a direct-fired system. Typically, ambient inlet air temperature at 203 can be as low as 0° F. The heated mixture discharged at duct 208 may be as low as 60° F. Although the combustion gas dew-point is well above this, the dilution with ambient air obviates condensation and the moisture vapor of combustion contributes somewhat to the comfort factor of the make up air.

Figure 3:
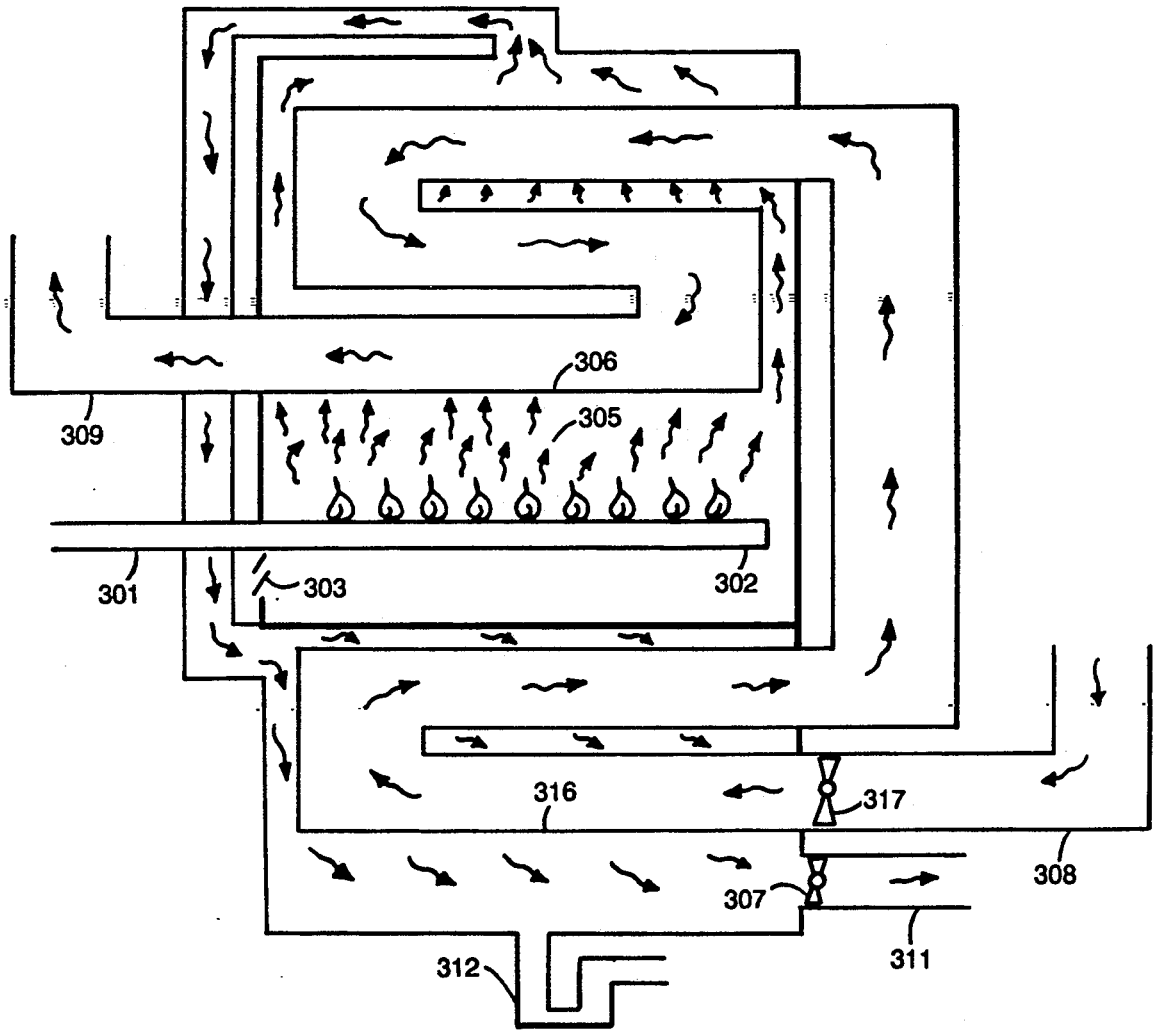
PRIOR ART FIG.3
FIG. 3 is a diagrammatic view of the principal features of a high-efficiency, two zone furnace (prior art).

FIG. 3 represents, in principle, the various features of a two-zone, so-called high efficiency furnace (prior art). Fuel gas from 301 and air from 303 burn at 302 and combustion gases as well as radiation of the fire heat the fire-box zone 305 in which the primary heat exchanger 306 is located. After partial cooling through heat exchanger in 306, combustion gas is drawn through a secondary heat exchanger 316 by fan 307. Ambient air fan 317 draws an air stream from the space to be heated via inlet duct 308 and discharges the cold ambient air into the air side of the secondary heat exchanger 316. Here the air is partially warmed and the exhaust gas is cooled to its own discharge temperature. The warmed air is then blown through the primary heat exchanger 306 to be heated to 100°-120° F. and discharged into space heating ductwork 309. The cooled exhaust leaving primary heat exchanger 306 is still at 400° +F. well above its dew-point. However, in the secondary heat exchanger 316 the exhaust gas temperature is dropped to within about 10° F. of the cool ambient air it meets there. Because the inlet air temperautre at 308 is likely to be around 60° F., the exhaust gas temperature will likely be dropped to about 70° F. For heat salvaging purposes this is very desirable. However, the incidental effect of condensing water vapor to liquid also is experienced. Here, too, there is heat-reclaiming value due to liberation by the condensate of the latent heat of vaporization of the water. But this condensate will dissolve gases from the exhaust gas mixture. Transient sulfur oxides, hydrochloric acid, as well as combustion $CO_2$ and $NO_x$, all form acidic solutions in water. This liquid must be conveyed away from the secondary heat exchanger by drain outlet 312 after separating from the cooled exhaust stream, which is discharged by fan 307 into disposal duct 311. The acidic liquid may not be readily disposable without neutralization.

Figure 4A:
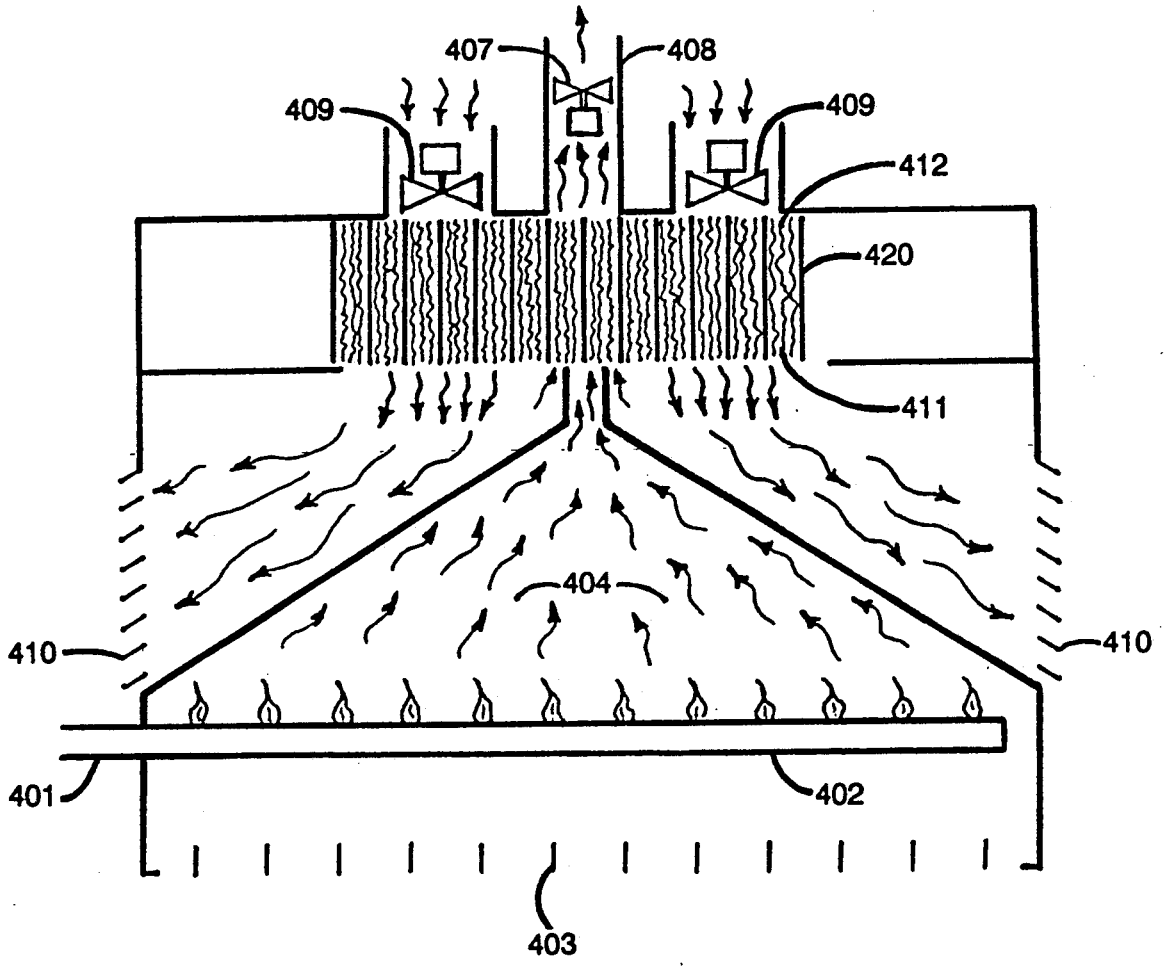
FIGS. 4A, 4B and 4C are cross-sectional views, somewhat diagrammatic, of a preferred embodiment of the invention.

FIG. 4A is a diagrammatic view of the preferred embodiment of the invention. Fuel gas entering via pipe 402 is burned with air entering at 403 creating combustion gases 404. A porous heat sink element identified as 420 is reciprocated between the extreme positions shown in FIGS. 4B and 4C several times per minute. In so doing every part of the element is exposed alternately to the hot combustion gas stream emanating from the fire drawn through the porous element by suction fan 407 mounted in final exhaust duct 408 and one or the other of two cool ambient air streams blown through the porous heat sink by fans marked 409. Hot combustion gas products enter the porous heat sink via face 411 and after being cooled leave via face 412. Cool ambient air enters the porous heat sink element via face 412 and after being heated exits via face 411.

Figure 4B:
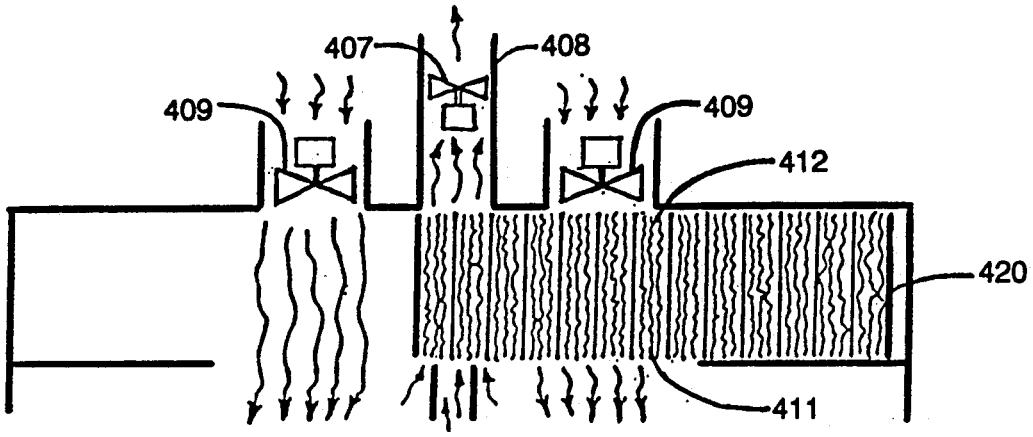
Figure 4C:
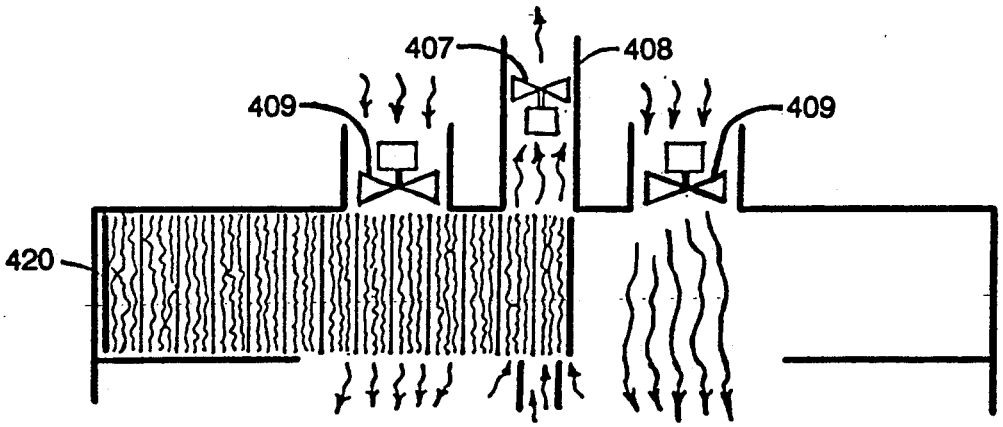

In FIGS. 4A-4C the heat sink element is shown as being supported in a frame which is divided into twelve identical compartments. In a practical example, each compartment is 1.5 inches wide, 6 inches deep (direction of airflow), 8 inches tall and holds 4 ounces of knitted aluminum wire mesh. This corresponds to an open space, or pore volume of about 96% in the heat sink element. As stated, the heat sink material is alternately heated by the hot combustion gas and cooled by the ambient air, several times per minute. The reciprocating motion of the element is such that for each pass in front of the hot gas the element passes in front of one or the other of the two cool air streams twice, thereby exposing the element to cool ambient air for twice as long as it had been in the hot gas flow.

The two heated ambient air streams exiting face 411 downstream of each of the two blowers may be ducted in at least three different ways: (1) separately to the space to be heated, (2) simply discharged via louvers such as those identified as 410, or (3) joined in a common plenum (not shown) before ducting to the heated space. The heat-sink element, at the end of each stroke, passes beyond the outlet of one of the blowers while the second blower is discharging its air stream through the heated porous heat sink. If the two discharges are joined in a common plenum, blending the cool air with the hot air for an instant suppresses any significant temperature peaks. If each heated air stream is to be ducted separately to a space it may be desirable to provide two separate mixing plemuns for each stream. A plenum can be as simple as a box big enough to hold a few seconds flow of heated air. The ambient air fed to each blower may come from a common duct, and the heated air returned via a common duct to the space from which the cool ambient air had been drawn. Alternatively, the two separate heated air streams may be independently ducted to spaces to be heated.

Purging is done of combustion gas from the pore volume of the heat sink before ambient air flows into the heated air return duct. As the element passes out of the hot combustion gas flow, and just before it reaches the ambient air main flow, it passes for a very brief instant in front of a slit which provides a flow path through the porous heat sink form the ambient air to the suction side of the exhaust blower. The effect of this is to permit replacing the small volume of residual exhaust gas in the pores of the heat sink with ambient air without losing any exhaust gas heat.

Although FIGS. 4B–4C indicate that the discharge of each of the blowers is a rectangle whose sides are equal to the fan blade width, this is not a limitation; the cool gas stream can be admitted to the mesh over any area provided the net effect of flowing the cool air is to collect from the heat sink the heat absorbed by it in the preceding exposure.

As has already been noted, during one complete passage of the heat sink element across the flow streams, it passes sequentially in front of a single hot gas stream and two cool ambient air streams. Furthermore, the element spends about twice as much time in the flow of the cooling air streams as it spends in the hot gas flow stream in the immediately preceding part of the cycle. The velocity of the air streams is also substantially greater than that of the hot combustion gas stream. Thus, the total volume of cooling air driven though the porous heat sink is as much as five to ten times that of the hot combustion gases per cycle, thereby ensuring the complete cooling of the heat sink.

Figure 5A:
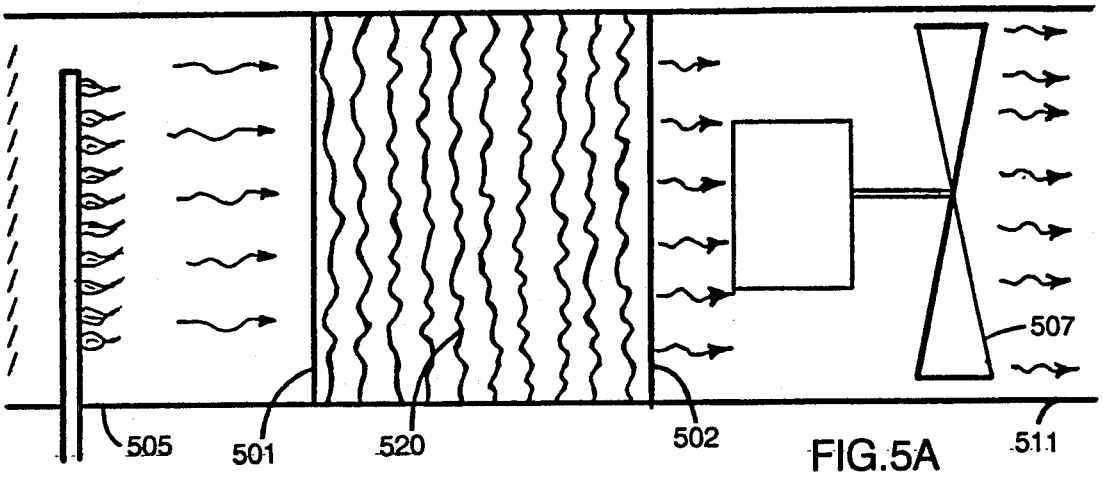
FIGS. 5A–5B are, respectively, diagrammatic cross-sectional views through an element of the heat sink material of said preferred embodiment at two different points in the heat transfer cycle of said material.
Figure 5B:
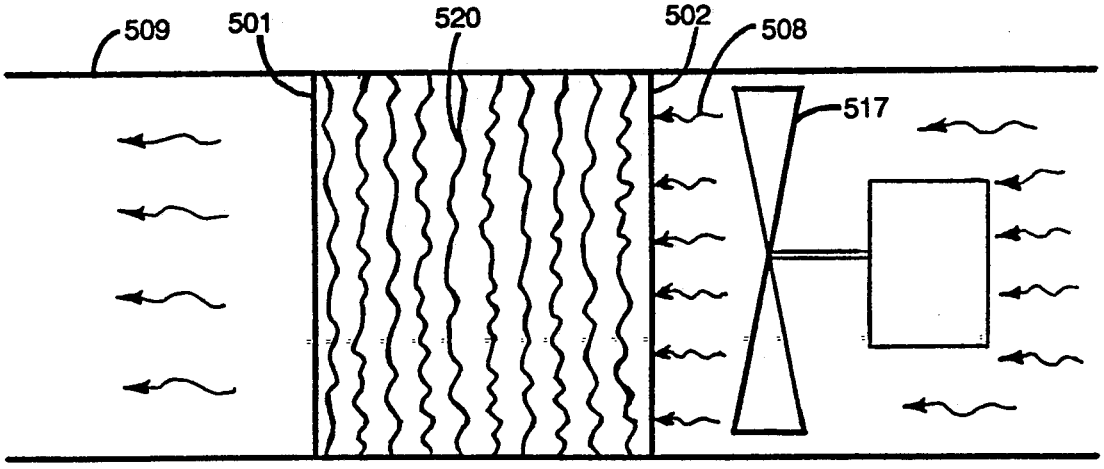

FIGS. 5A and 5B are diagrammatic cross-sections through an element 520 of heat sink material (shown as 420 in FIG. 4) at two positions during its reciprocation. In FIG. 5A, element 520 is shown being heated by combustion gas from fire-box 505. Hot gas is drawn into front face 501 of the heat sink and out back face 502 by fan 507 which discharges cooled exhaust into duct 511 for disposal to the external environment. In FIG. 5B, the porous heated element has been moved to a position where it intersects the flow path of a stream of cool ambient air 508 blown into back face 502 of the heat sink by blower 517, which serves the same function as blower 409 of FIG. 4. The heated ambient air which emerges through face 501 is not the same temperature at each instant, ranging from about 100° F. to as high as 500° F. over the very short interval of less than three seconds. To avoid temperature surges, heated air from a pair of blowers as shown in FIG. 4 might be joined in a plenum and returned via duct 509 to the space being heated. The fuel/air ratio is set so that hot exhaust is about 1100° F. Passage through the heat exchanger cools the exhaust to about 10° F. above the ambient air, which is around 70° F. Thus the final temperature of exhaust exiting through duct 511 is around 80°–90° F.

While moving through the porous heat sink and being cooled from about 1000° F. to about 80° F. the exhaust gas passes through its dew point temperature. Moisture condenses on the surfaces of the porous element. However, the residence time of the element in the exhaust stream before it is exposed to the reverse flow of ambient air is so short that there is no opportunity for significant solubilization of acid gases before the liquid water is re-evaporated into the under-saturated ambient air stream. Thus, little or no damaging corrosion is experienced by the heat exchange element, no offensive liquid condensate needs to be discharged, and the ambient air enjoys the benefit of comfort humidification.

As exhaust gas emerging from face 502 of the heat sink has been cooled to within a few tens of degrees of the space being heated (preferably to within 30° F. and more preferably to within 20° F.), substantially all of the sensible heat of combustion has been extracted by the heat sink and released into the air stream. However, in addition to that effect, condensed moisture from cooled exhaust is re evaporated into the air stream. On first consideration this seems to have a neutral enthalpic effect—the heat of vaporization released during the condensing step is offset by the heat of vaporization taken out of the ambient air stream. However, on reflection it will be realized that because comfort heated air invariably requires humidification, evaporation of water from whatever source it may be derived will consume the same amount of heat energy as is required in the re-evaporation of the condensate in the porous heat sink. The two stage high efficiency furnaces, while realizing the heat of condensation, are not immune to humidification heat consumption penalties. Thus, the invention provides a benefit equivalent to the dew-point condensation step of the high efficiency furnace without the penalties of corrosion and acidic liquid disposal.

FIGS. 6A–6H are time-related plots of temperature profiles through the porous heat sink corresponding to a cycle of heating up A–D by combustion gas and cooling down E–H by the ambient air stream. In each plot the local instantaneous mesh temperature is shown as a solid line; the local gas or air temperature is shown as a dotted line. It should be noted that the profiles are constructed from actual measurement of air and gas temperature immediately up and down-stream of the mesh. The temperature of the mesh was also measured on both exposed surfaces and halfway between them. Thus FIGS. 6A–6H may be taken as reasonably accurate representations of the actual temperature history of both the mesh and the flowing air and gas streams.

Figures 6A, 6B, 6C, 6D, 6E, 6F, 6G, 6H:
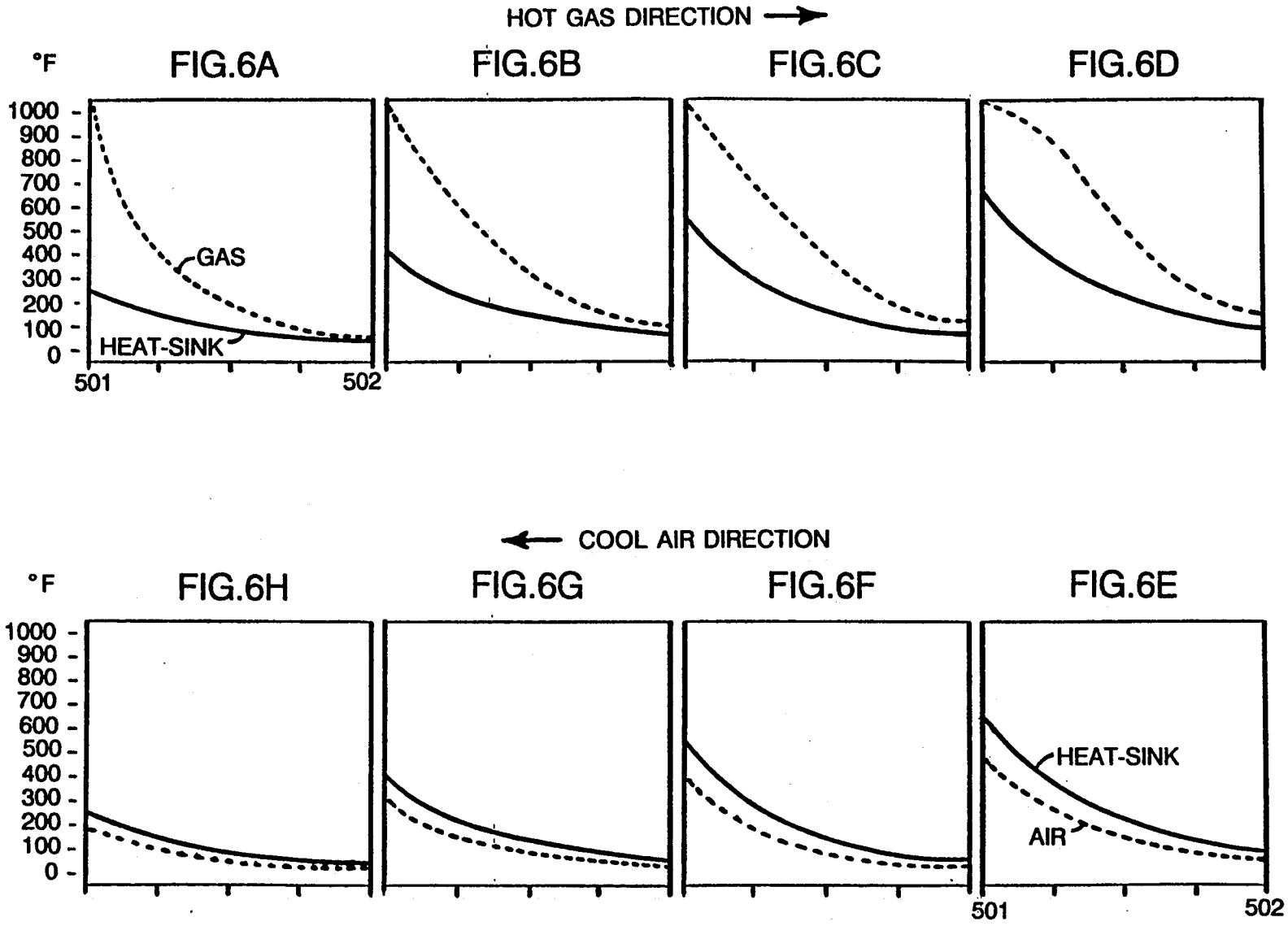
FIGS. 6A–6H are plots indicating the time-related temperature profiles within an element of the heat sink material during the flow of hot combustion gas (A-D) followed by the flow of cool ambient air (E-H).

Faces 501 and 502 of FIG. 5 correspond to the same positions indicated in the plots of FIG. 6. Hot gas flows from 501 to 502; cool air flows from 502 to 501. The average heat-up period per cycle for an element of porous heat sink is on the order of 1.5 seconds. The four plots 6A–6D represent temperature profiles at the first instant of exposure, 0.5 second, 1.0 second and 1.5 seconds later, respectively. FIG. 6D, being the last instant of heat exposure, corresponds with the first instant of cooling, and therefore the mesh profile of FIG. 6D is the same as that of 6E where it is first presented to the air stream. Likewise, the mesh temperature profile at the last instant of cooling, FIG. 6H, corresponds to its condition on first exposure to hot gas, FIG. 6A. The intervals between FIGS. 6E and 6H are, however, about twice those of FIGS. 6A–6D, because the mesh spends twice as long being cooled as being heated in each cycle.

The several temperature profiles are instructive in understanding operation of the invention. First, the hot gas always starts at face 501 at 1050° F.; the cool air always starts at face 502 at 70° F. Mesh surface 501 fluctuates from about 250° F. to 650° F. as the mesh alternates between heating up and cooling off, but the mesh at face 502 fluctuates only between about 80° and 90° F. Introducing cool ambient air in sufficient volume at face 502 provides for cooling the exit face for exhaust to the lowest feasible temperature, thereby cooling the exhaust gas also to the greatest feasible extent. The cooling effect of the ambient air flow is so profound that the mesh surface from which cooled exhaust emerges is substantially never more than about 10°–20° F. above ambient temperature. On the other hand the temperature of the mesh surface through which the heated air emerges, as well as the heated air itself, are both subject to reasonably wide excursions of temperature (these swings in temperature may be readily handled by mixing the two heated air streams).

Another notable feature is that the combustion gas dew-point is reached about midway through the heat sink and moves slightly toward the exit face 502 as the heat sink warms. Exhaust gas remains saturated with water at temperature well below the original combustion gas dew-point. Ambient air entering at 70° F. is rapidly heated by as much as 100°–400° F., but hot exhaust entering 502 cools nearly 1000° to 80° F. during the process. This is because the net total flow of ambient air per cycle is 6 times that of the hot exhaust gas. These exposures occur during element reciprocation at the frequency of about 8.5 full repeats per minute. On average, each element of the heat sink is exposed to the equivalent of 17 pulses of hot gas and 34 pulses of cool air per minute. This can be equated to 20 seconds of heating and 40 seconds of cooling, with each heating interval persisting for less than 1.5 seconds, and each cooling interval lasting about three seconds, with about six times as much cool air as hot gas flowing per cycle.

It is interesting that the mesh temperature profiles are similar at the instant of reversals from heating to cooling and cooling to heating; plots 6B and 6G are similar to one another as are plots 6C and 6F, reflecting the fact that the inner zones of the mesh rise and fall in temperature in a smooth, albeit rapidly, fluctuating fashion. But the exhaust exit face remains nearly constant in the 80°–90° F. range.

The practical significance of the invention can be understood using an example. The device shown in FIG. 4 was installed so as to receive at its hot gas inlet the entire gaseous output of combustion of a 200,000 btu per hour propane gas burner. Burner air feed and exhaust fan adjustments were such that the hot gas inlet received a gas stream at 1050° F. at an estimated flow rate of 300 cubic feet per minute. The air blowers each discharged about 450 cubic feet per minute of air drawn directly from the ambient environment.

The heat sink unit was reciprocated between the extremes of its stroke 17 times per minute. At these extremes, one blower discharged its air stream through the heat sink element into the ambient while the other blower output simply returned directly to he ambient. Blower air entered the heat sink surface out of which combustion gas had been drawn by the exhaust suction fan. The cooled exhaust gas was ducted to the outdoors. Measurements of the inlet ambient air temperature and combustion gas temperatures and dew-point up and down-stream of the unit taken at five minute intervals are shown in Table I.

TABLE I

| | An Experimental Illustration | | | | | |
|---|---|---|---|---|---|---|
| | Combustion Gas Properties | | | | | |
| | Temp. °F. | | Dew Point °F. | | Ambient Air Properties | |
| Time Interval | Up-Str. | Dn-Str. | Up-Str. | Dn-Str. | Temp. (°F.) | Rel. Hum. (%) |
| After 5 min. | 1050 | 83 | 155 | 75 | 63 | 50 |
| After 10 min. | 1050 | 86 | 155 | 78 | 68 | 50 |
| After 15 min | 1050 | 89 | 155 | 81 | 73 | 50 |
| After 20 min | 1050 | 91 | 155 | 83 | 78 | 50 |
| After 25 min | 1050 | 93 | 155 | 85 | 83 | 50 |

The tabulated data indicate, for one thing, that the air temperature of the room out of and into which the ambient air blowers were drawing and discharging was raised 20° F. (83–63) over the half-hour duration of the test. Had the air been discharged into ductwork serving an entire house, and had the blowers drawn from the same source, the temperature rise of the house air would certainly not have been as extreme as was produced in the room in which the demonstration test was conducted. The data also illustrate the dramatic cooling of the combustion gas which occurs during its brief passage through the heat sink. Considering that the frequency of reciprocation of the heat sink was 17 cycles per minute, the average residence time in the hot gas of any element of heat sink during any stroke was less than 1.5 seconds. In view of the velocities of the gas and air streams and the brevity of the exposure time, steady-state thermal and moisture equilibrium would not have been reached.

On cooling from 1100° F. to 90° F. the hot gas contracted about 50% in volume. However, it also passed through its 155° F. dew-point. There was no sign of condensate on any parts of the apparatus. Nevertheless, the dew-point of the cooled exhaust was found to have dropped to a temperature somewhat lower than the exhaust gas temperature and somewhat higher than the ambient air temperature measured at the time. This is exactly the effect to be expected if there had been condensation of water vapor on the surfaces of the heat sink material cooled at some position through its thickness to a temperature intermediate that of the alternating flows of gas and air. Condensate left on the heat sink from the combustion gas must have been re-evaporated into the warmed ambient air stream. This is consistent with the observation that the relative humidity of the room remained unchanged around 50% during the test while ambient temperature rose 20° F.

Several other features of the example should be noted. One is that the ultimate exhaust gas temperature had been reduced to within 20° F. of the air temperature (actually to within 10–15° F.). Thus, a small increase of exhaust gas volume by adding excess air to the fire imposed only a minor heat loss penalty. On the other hand, burning the fuel gas at a somewhat reduced temperature suppresses $NO_x$ formation, and more air favors conversion of CO to $CO_2$. These effects are desirable both as regards heat economy and reduction of offensive gas products in the exhaust.

A second, somewhat related feature is the effect of condensate temperature on acidic gas solubility. Table II is instructive.

TABLE II

| Temp °F. | Solubility in Water (wt %) @ 760 mm | | | | | | |
|---|---|---|---|---|---|---|---|
| | $CO_2$ | $NO_2$ | $SO_2$ | $O_2$ | $N_2$ | CO | HCl |
| 32 | .33 | .0098 | 22.8 | .0069 | .0029 | .0044 | 82.3 |
| 50 | .23 | .0075 | 16.2 | .0054 | .0023 | .0035 | |
| 68 | .17 | .0062 | 11.3 | .0043 | .0019 | .0028 | |
| 86 | .13 | .0052 | 7.8 | .0036 | .0016 | .0024 | 67.3 |
| 104 | .10 | .0044 | 5.4 | .0031 | .0014 | .0021 | 63.3 |
| 122 | .08 | .0038 | 4.5 | | | | 59.6 |
| 140 | .06 | .0027 | | | | | 56.1 |

Table I showed that exhaust dew-point fell to about 80° F. after flowing through the heat sink which had been cooled by air at about 70° F. This suggests that porous heat sink surfaces on which condensate formed were at about 80° F. Bearing in mind that flow rates and cycle times were such that steady-state equilibrium was unlikely, these effects are quite consistent with each other and observed exhaust temperature of about 86–89° F. The information of Table II indicates that the acid forming gases are 30–50% as soluble in water at the exhaust gas dew-point as at 50° F. At least one advantage, therefore, of the present invention is that the dew-point temperature is kept high enough to suppress solubility of acid-forming gases in the condensate.

Another effect also needs to be taken into account, namely, that the exposure time of condensate to hot gases is very short and thus reaching equilibrium concentration of dissolved gas is very unlikely. The following calculation is instructive. The cross-section through which hot gas passed was 0.35 sq. ft. The cooled gas was drawn through the mesh at 150 cfm representing an outlet velocity of about 450 feet per minute. Accounting for the fact that 1000° F. inlet gas is about half as dense, and therefore twice the volume for a given weight, results in an estimated inlet velocity of 900 feet per minute. The fraction of the cross-section occupied by wire was only about 4%. and so for practical purposes does not affect the velocity estimates.

The first half of the porous heat sink depth would not likely be the zone for condensation since the gas enters at about 1000° F. and is not likely to be cooler than 155° F. before traversing at least half of the mesh. Thus, as little as half of the six-inch mesh thickness is likely to be at or below the combustion gas dew-point. In this zone the first portion would be so hot that condensate would be forming at a temperature near 155° F. and in the latter portion at a temperature above about 80° F. Moreover, it should also be noted that the gas would have traversed the three inches in about 0.2 seconds.

The instant that hot gas stops flowing a trace of ambient air is drawn into the mesh as a purge for combustion gas residues, and this flow is immediately followed by the main stream of ambient air flowing in the opposite direction at a volume rate about three times that of the exhaust gas. Any acidic gases that have dissolved in the surfaces of condensed water films, would probably not have had time to diffuse to the surface of the wires comprising the mesh before being swept away with the evaporating water. Thus, little corrosion is likely, and none has actually been observed. The acidic gas which might have dissolved and re-evaporated is slight and inoffensive in the atmosphere.

Another aspect of the invention pertains to the heat burden and heat absorption capacities of the flow streams and heat sink. Information pertinent to these matters is in Table III (data are shown for aluminum, stainless steel, and silica heat sink materials).

TABLE III

| Material | Cubic Feet per Lb. | | Spec. Ht. (btu/lb) | | Rel. Cond. | | M. Pt. (°F.) |
|---|---|---|---|---|---|---|---|
| | 72° F. | 1000° F. | 72° F. | 1000° F. | 72° | 1000° F. | |
| Air | 12.4 | 23.7 | 0.24 | 0.25 | | | |
| $N_2$ | 12.6 | 23.8 | 0.25 | 0.26 | | | |
| $CO_2$ | 8.1 | 15.3 | 0.20 | 0.21 | | | |
| $H_2O$ | 26.8 | 44.1 | 0.48 | 0.51 | | | |
| Al | .0059 | .0060 | 0.22 | 0.27 | 0.5 | 1.1 | 1200 |
| S.S. | .0021 | .0021 | 0.11 | 0.16 | 0.1 | 0.1 | 3000 |
| Silica | .0060 | | 0.25 | 0.27 | 0.0025 | | NA |

The first item to explore is the heat load in the combustion gas. It will be remembered from earlier discussions that this gas is composed largely of nitrogen with some carbon dioxide, water vapor and excess air. It is reasonable, therefore, to use the specific heat and density properties of air, taking account of temperature, of course, in calculating heat capacity and heat transfer effects in the process for both the ambient air and the combustion gas.

Consider that exhaust flow was 150 cubic feet per minute at about 80° F. This would represent a weight flow of about 12 pounds per minute of gas having a specific heat of 0.24 btu per pound. This weight of gas and specific heat apply both to the cooled and hot (i.e., 1000° F.) gas, which would be about half as dense but flowing twice as fast. It will give up enough heat to drop 970° F. (1050°–80° F.) flowing through the heat sink. Therefore the total heat burden carried by the hot gas to the sink is $(0.24 \times 12 \times 60 \times 970) = 167{,}000$ btu per hour. This is consistent with the nominal 200,000 btu/hr output rating of the burner.

As for the heat absorbing performance of the aluminum mesh, the following items come into play. First, note that the entire weight of mesh in the unit was 4 ounces per compartment distributed in 12 compartments. Allowing for the fact that the outer two compartments are exposed to the hot gas for very short periods of time on each stroke, it is reasonable to use, for calculation purposes, an effective heat sink weight of 40 ounces, (2.5 lbs). This weight is heated and cooled $60\times17.5$ times per hour, which represents an effective total active weight of $(2.5\times17.5\times60)=2625$ pounds of aluminum absorbing the input heat. Given the specific heat of Al of 0.25 btu per pound per degree F and a total heat burden of 167,000 btu per hour leads to an average rise of 254° F. for the heat sink in each cycle, which is consistent with the fact that the mesh reaches about 650° F. on its heated face when the cool surface is still only about 10°-20° F. above ambient temperature.

As for heat balance with ambient air flow, the following applies. Cool air flow rate is three times that of cool combustion gas. With flow time of the cool air twice that of the hot gas per cycle, the mesh is exposed to six times as much by weight of cool air as of hot gas. On a simple proportionality basis, therefore, the cool air temperature rise can be expected to be about one sixth as much as the hot gas cools. Considering that the hot gas cools about 1000° F., the air that emerges from the mesh can be expected to have been warmer by about 160° F. This is actually what is observed, although instantaneous very short duration peaks of 500° F. occur; this is offset by blending the heated air stream with the air stream bypassing the element at the end of each stroke.

Important principles exemplified above are these. The heat absorbing function of the heat sink depends on the specific heat of the material of which it consists, the weight exposed per cycle, and the duration and frequency of cycles. Although the example cited above employed about 40 ounces of aluminum exposed 17 times per minute, clearly other cycle frequencies could have been used, provided that the total heat burden of the hot gas is absorbed and then given up to the ambient air. Given that proviso, it is clear that other weights, or other materials can be used. While not previously specifically stated, it is implicit that the heat sink material must be suitably distributed in the path of the air and gas flows, and the material's heat transfer properties and geometry must also be good enough to conduct the heat absorbed at gas-solid interfaces to interior regions of the material and then out again on cooling.

It is also important that the cooler heat sink surface through which the combustion gas flows be the one out of which the combustion gas emerges. The best way to achieve this is to have this be the surface into which the cool air is admitted. Moreover, the cool air flow is preferably enough greater than the hot gas flow that the cooler surface of the heat sink will not be more than about 10° F. above ambient. Thus, the cool air flow is preferably about 5 to 10 times that of the hot gas. This can be accomplished in a number of ways. One is to blow the ambient air through about the same cross-sectional area of mesh as the hot gas flows through but at a higher velocity. Another way would be to increase the cross-sectional flow area for cooling air. It is also possible to flow the cooling air through a smaller cross-section but at very much higher velocity.

OTHER EMBODIMENTS

Other embodiments of the invention are within the scope of the claims.

Although aluminum wire was used in the example, it is not the only material useful in practicing the invention. Bearing in mind that the melting point of aluminum may be perilously close to the combustion gas temperature, it could be replaced by a material with a higher melting point. Ceramic refractory materials such as silica are possibilities. Table III provides some properties of silica. It is evident that, insofar as bulk density and specific heat are concerned, silica and aluminum are quite similar. But in respect to heat transfer, silica is very different. It is the very low rate of heat transmission of ceramic refractories, of course, that make them so useful as insulators. But the geometry of silica may make up for its lower rate of heat transmission. If silica were to be used in the form of 1 mil fibers rather than the 10 mil aluminum of the example, there would be 100 times as many fibers for the same weight. Each would have one tenth the surface area of a 10 mil fiber with the net effect that the surface area of silica fiber would be ten times that of the aluminum of the example. Moreover, the thickness of silica through which the heat would have to flow from gas-solid boundaries to fiber interiors would be one-tenth that of the aluminum wire case. Ten times the surface area and one-tenth the heat path length will go a long way towards overcoming the hundred-fold thermal conductivity difference. Silica, or some other refractory ceramic fiber, is, therefore a possible alternative. Such materials could well be used as the surface into which the hot gas is first admitted. Indeed, it might be well to use it only in the zone which is expected to remain at well above dew-point condensation temperature. Conceivably, therefore, one might use a multi-layer assemblage of two or more materials for the heat sink.

Stainless steel is another possible material. While stainless has only about half the specific heat of aluminum, it is about three times as dense. Thus, for the same volume of steel wire there would be 50% more net heat capacity at about three times the weight. The weight of the mesh is a trivial factor in cost and mechanical aspects of the invention, so there is no meaningful penalty in the added weight of stainless over aluminum. But the lower thermal conductivity of stainless would call for some adjustment of geometry as in the case of silica, although a much less drastic one. Cutting the diameter from 10 to 3 mil would triple the gas-solid surface area and reduce thermal path length to one third that of the example. These two effects, coupled with the 50% net higher heat capacity, should produce a heat sink mesh comparable in efficiency to that of the example. In any case, just as for silica, the stainless wire could be strategically located at the higher temperature face in a multilayer assembly with aluminum.

While the example and several alternatives just discussed all reference a heat sink comprised of a wire mesh, this, too, is not a limitation of the invention. Porous heat sinks can be fabricated from a wide variety of substances and in many forms. One form known as honeycomb monolithic is made from selected inorganic oxides for use in auto exhaust catalytic converters. It is manufactured by extruding a ceramic precurser as a continuous body, say 6 to 10 inches in diameter. The body is not solid, however, but comprises a system of throughgoing hexagonal or rectangular passages parallel to the long axis of the body. A cross-section made through the body perpendicular to its long axis would expose a reticular surface very much like a honeycomb in appearance. Slabs of this material of any reasonable thickness can be made either before or after firing the "green" precursor. The free space provided by the passages represents as much as 60% or more of the cross-section. The passage diameters can be from a small fraction of an inch up to an inch or more. In use for catalytically treating auto exhaust fumes, these gases are made to flow down the length of the throughgoing passages. Such bodies could be adapted as to geometry and other qualities to serve in the present invention.

Other forms of porous ceramic are known, such as open-cell foam. Likewise, other methods of assembling wires or fibers besides in the form of knitted mesh are known and would be adaptable for forming a porous heat sink material suitable in the invention. Besides building multi-component assemblies in several laminae of different materials, such laminae could be of the same material but different geometry. It is also possible to blend two or more materials in a common lamella.

Whereas the foregoing description deals with an arrangement for absorbing combustion gas heat in a single porous heat sink element, it is possible to visualize an arrangement in which two or more heat sinks are arranged in sequence, each operating independently but together performing the process to which this invention is directed. It is also emphasized that, although the example describes a heat sink element reciprocated back and forth between hot gas and cool air streams, the principles of the invention can as well be embodied in a method where the heat sink is in the form of a continuous endless loop or series of linked elements which are moved in one direction only but in an endless closed path. Likewise, a rotating wheel device can be adapted to meet the requirements and perform the process of this invention.

Finally, while the process, in its principle emobodiment functions to collect and release substantially the entire heat output of the fuel by means of the porous heat sink, one can visualize that it is possible to create a system in which a small part of the flame heat is absorbed in a separate air stream directed at or around the firebox and eventually merged with the principal flow of heated ambient air derived through the heat sink operation. Such a combination of two hot air collection means would still benefit from the invention because the eat sink is responsible for collecting the majority of the heat.

As another variant of the method and apparatus described herein, it should be noted that while two separate blowers were used in the example described there is no inherent reason why a single blower could not be used and the output of the one blower divided into two (or more) seperate air streams for delivery to the porous heat sink. By the same token, one can visualize a somewhat more elaborate air delivery system in which more than two blowers are sued in parallel to deliver the cool ambient air to the heated porous heat sink.

While all of the discussion of the method has been devoted to a device in which the hot combustion gas and the air streams are confined in essentially fixed ducts, and the heat sink translated into and out of these separate flowing gases, the method disclosed herein inherently anticipates another significant variant in which the heat sink remains fixed. In such a situation, the hot combustion gases and the cool ambient air would be directed into and through the porous heat sink alternatingly and separately from each other by a system of dampers, moving shutters, moving ducts, or the like.

I claim:

1. Space heating apparatus in which fuel gas is burned and heat is transferred from the resulting combustion gases to a cool air stream to produce heated air, said apparatus comprising:

a combustion chamber, said chamber comprising an inlet for receiving combusion air and a burner for burning fuel gas in said combustion air to produce combustion gases; and a primary heat exchanger for receiving said combustion gases and for extracting the majority of the heat of combustion from said gases, said primary heat exchanger comprising a porous heat sink member, ducting for delivering said combustion gases to said heat sink member, said gases being delivered along a combustion-gas path, a blower and ducting for directing cool air along a cool air path to said heat sink member, and means for drawing said combustion gases and cool air through said porous heat sink member so that portions of said member alternately pass through said combustion-gas path and said cool-air path, to transfer heat from said combustion gases to said cool air, wherein said cool air is directed to said heat sink member along two separate cool-air paths, and wherein said means for moving said heat sink member includes means to pass most portions of said member alternately through said combustion-gas path and both said cool-air paths.

2. The apparatus of claim 1 wherein there is a second blower, and said two cool-air paths each has its own blower.

3. The apparatus of claim 1 further comprising ducting for combining said two cool-air streams after they have been heated by passing through said heat sink member.

4. The apparatus of claim 1 wherein said ducting is arranged so that said cool air flows counter to said combustion gases.

5. The apparatus of claim 1 wherein the elements of said primary heat exchanger are adapted to cool said combustion gases to below dew point during passage of said gases through said heat sink member; wherein said means for drawing said combustion gases and cool air through said porous heat sink member further comprises means for reciprocating said heat sink member back and forth through said combustion-gas path and cool-air path; and wherein the elements of said primary heat exchanger are adapted so that the temperature of said combustion gases exiting said heat sink member is reduced to within 30° F. of the temperature of said cool air entering said member; wherein said apparatus further comprises purge means for purging said porous heat sink member of combustion gases by briefly passing cool air through said heat sink member to replace the small volume of residual combustion gases in the pores of the heat sink member; and wherein the elements of said primary heat exchanger are adapted so that said cool air flowing through said porous heat sink member re-evaporates any water vapor condensate formed within said heat sink member during passage of said combustion gases to that condensate does not accumulate within said porous heat sink member.

6. Space heating apparatus in which fuel gas is burned and heat is transferred from the resulting combustion gases to a cool air stream to produce heated air, said apparatus comprising:

a combustion chamber, said chamber comprising an inlet for receiving combusion air and a burner for burning fuel gas in said combustion air to produce combustion gases; and a primary heat exchanger for receiving said combustion gases and for extracting the majority of the heat of combustion from said gases, said primary heat exchanger comprising a porous heat sink member, ducting for delivering said combustion gases to said heat sink member, said gases being delivered along a combustion-gas path, a blower and ducting said combustion gases and cool-air path to said heat sink member, and means for drawing said combustion gases and cool air through said porous heat sink member so that portions of said member alternately pass through said combustion-gas path and said cool-air path, to transfer heat from said combustion gases to said cool air, wherein the elements of said primary heat exchanger are adapted to cool said combustion gases to below dew point during passage of said gases through said heat sink member.

7. The apparatus of claim 6 wherein the elements of said primary heat exchanger are adapted so the said cool air is partially humidified on passing through said heat sink member as the result of re-evaporation of water vapor condensate formed within said heat sink member during passage of said combustion gases.

8. The apparatus of claim 6 wherein said ducting is arranged so that said cool air flows counter to said combustion gases.

9. The apparatus of claim 1 or 6 wherein said means for drawing said combustion gases and cool air through said porous heat sink member further comprises means for reciprocating said heat sink member back and forth through said combustion-gas path and cool-air path.

10. The apparatus of claim 1 or 6 wherein the elements of said primary heat exchanger are adapted so that the temperature of said combustion gases exiting said heat sink member is reduced to within 30° F. of the temperature of said cool air entering said member.

11. The apparatus of claim 1 or 6 wherein the elements of said primary heat exchanger are adapted to that the temperature of said combustion gases exiting said heat sink member is reduced to within 20° F. of the temperature of said cool air entering said member.

12. The apparatus of claim 1 or 6 further comprising purge means for purging said porous heat sink member of combustion gases by briefly passing cool air through said heat sink member to replace the small volume of residual combustion gases in the pores of the heat sink member.

13. The apparatus of claim 1 or 6 wherein the elements of said primary heat exchanger are adapted so that the residence time of moisture condensing on the surfaces of said metal mesh is so short that solubilization of acid gases into the condensate occurring prior to re-evaporation is so insignificant as not to cause substantial corrosion of said heat sink member.

14. The apparatus of claim 1 or 6 wherein the elements of said primary heat exchanger are adapted so that substantially all of the sensible heat of combustion has been extracted by the heat sink and released into said cool air.

15. The apparatus of claim 1 or 6 wherein the elements of said primary heat exchanger are adapted so that said cool air flowing through said porous heat sink member re-evaporates any water vapor condensate formed within said heat sink member during passage of said combustion gases to that condensate does not accumulate within said porous heat sink member.

16. Space heating apparatus in which fuel gas is burned and heat is transferred from the resulting combustion gases to a cool air steam to produce heated air, said apparatus comprising:

a combustion chamber, said chamber comprising an inlet for receiving combusion air and a burner for burning fuel gas in said combustion air to produce combustion gases; and a primary heat exchanger for receiving said combustion gases and for extracting the majority of the heat of combustion form said gases, said primary heat exchanger comprising a porous heat sink member, ducting for delivering said combustion gases to said heat sink member, said gases being delivered along a combustion-gas path, a blower and ducting for directing cool air along a cool air path to said heat sink member, and means for drawing said combustion gases and cool air through said porous heat sink member so that portions of said member alternately pass through said combustion-gas path and said cool-air path, to transfer heat from said combustion gases to said cool air, wherein said combustion chamber is defined by a canopy and wherein said apparatus further comprises means for adjusting the temperature of the combustion gases by partial cooling of said canopy.

17. The apparatus of claim 16 wherein said ducting is arranged so that said cool air flows counter to said combustion gases.

18. Space heating apparatus in which fuel gas is burned and heat is transferred from the resulting combustion gases to a cool air stream to produce heated air, said apparatus comprising:

a combustion chamber, said chamber comprising an inlet for receiving combusion air and a burner for burning fuel gas in said combustion air to produce combustion gases; and a primary heat exchanger for receiving said combustion gases and for extracting the majority of the heat of combustion from said gases, said primary heat exchanger comprising a porous heat sink member, ducting for delivering said combustion gases to said heat sink member, said gases being delivered along a combustion-gas path, a blower and ducting for directing cool air along a cool-air path to said heat sink member, and means for drawing said combustion gases and cool air through said porous heat sink member so that portions of said member alternately pass through said combustion-gas path and said cool-air path, to transfer heat from said combustion gases to said cool air, wherein said porous heat sink member is a metal mesh.

19. The apparatus of claim 18 wherein said ducting is arranged so that said cool air flows counter to said combustion gases.

20. The method of heating and supplementing the humidity of an enclosed space such as a building, comprising the steps of:

(a) burning a clean fuel gas within an enclosed chamber to produce hot combustion gases, (b) drawing said hot combustion gases through a cool porous heat sink member for a first brief time interval during which said member absorbs the majority of the heat of combustion in said combustion gases and is thereby warmed and said combustion gases are thereby cooled to below dew point, (c) discharging said cooled combustion gases outside of said enclosed space, (d) passing cool air through said warmed heat sink member during a second brief time interval immediately following said first time interval to heat said air and re-evaporate any water vapor condensate formed within said heat sink member during passage of said combustion gases, and (e) discharging said heated and humidified air into said enclosed space.

21. The method of claim 20 wherein said second time interval is long enough and said cool air is at a flow rate selected so that the heat energy liberated into said heat sink member by said combustion gases is substantially fully absorbed by said cool air stream and said heat sink member has been cooled to nearly the temperature of said entering cool air.

22. The method of claim 20 wherein the temperature of said combustion gases exiting said heat sink member is reduced to within 30° F. of the temperature of said cool air entering said member.

23. The method of claim 22 wherein said cool air flows counter to said combustion gases.

24. The method of claim 22 wherein said exiting combustion gas temperature is within 20° F. of said entering cool air.

25. The method of claim 20 wherein said cool air is directed to said heat sink member along two separate air paths, and wherein said heat sink member is moved so that most portions of said member pass alternately through said combustion gas and both of said air paths.

26. The apparatus of claim 25 wherein said cool air flows counter to said combustion gases.

27. The method of claim 20 wherein no condensate accumulates as the result of said process.

28. The method of claim 20 further comprising purging combustion gases from a portion of said heat sink member by directing cool purge air through said portion along a purge air path positioned immediately adjacent said combustion air path, so that cool purge air is drawn through each portion of said porous heat sink member immediately following passage of that portion through said combustion air path.

29. The method of heating an enclosed space such as a building, comprising the steps of:

(a) burning a clean fuel gas in an enclosed chamber to produce hot combustion gases, (b) drawing said hot combustion gases through a cool porous heat sink member for a first brief time interval during which said member absorbs the majority of the heat of combustion in said combustion gases and is thereby warmed, (c) discharging said cooled combustion gases outside of said enclosed space, (d) passing cool air through said warmed heat sink member during a second brief time interval immediately following said first time interval to heat said air, and (e) discharging said heated air into said enclosed space, wherein said combustion gases are cooled to below dew point during passage through said heat sink member.

30. The method of claim 29 wherein said cool air is partially humidified on passing through said heat sink member as the result of re-evaporation of any water vapor condensate formed within said heat sink member during passage of said combustion gases.

31. The method of claim 29 wherein no condensate accumulates as the result of said process.

* * * * *

UNITED STATES PATENT AND TRADEMARK OFFICE

CERTIFICATE OF CORRECTION

PATENT NO. : 5,005,556

DATED : 4/9/91

INVENTOR(S) : William B. Astle, Jr.

It is certified that error appears in the above-identified patent and that said Letters Patent is hereby corrected as shown below:

Column 3, line 62, "though" should be --through--.

Column 4, line 54, "featues" should be --features--.

Column 6, line 22, "temperautre" should be --temperature--.

Column 7, line 15, "plemuns" should be --plenums--.

Column 7, line 50, "though" should be --through--.

Column 8, line 30, "re evaporated" should be --re-evaporated--.

Column 10, line 15, "he" should be --the--.

Column 15, line 39, "eat" should be --heat--.

Column 16, line 1, "combusion" should be --combustion--.

UNITED STATES PATENT AND TRADEMARK OFFICE

CERTIFICATE OF CORRECTION

PATENT NO. : 5,005,556

DATED : 4/9/91

INVENTOR(S) : William B. Astle, Jr.

It is certified that error appears in the above-identified patent and that said Letters Patent is hereby corrected as shown below:

Column 16, line 66, "combusion" should be --combustion--.

Column 17, lines 9-10, "said combustion gases and" should be replaced with --for directing cool air along a--.

Column 18, line 8, "combusion" should be --combustion--.

Column 18, line 39, "combusion" should be --combustion--.

Signed and Sealed this

Sixteenth Day of February, 1993

*Attest:*

STEPHEN G. KUNIN

*Attesting Officer*

*Acting Commissioner of Patents and Trademarks*